US011390414B2

(12) United States Patent
Naveau et al.

(10) Patent No.: US 11,390,414 B2
(45) Date of Patent: Jul. 19, 2022

(54) CONTAINER WITH A PETALOID BASE

(71) Applicant: SIDEL PARTICIPATIONS, Octeville-sur-Mer (FR)

(72) Inventors: Laurent Naveau, Octeville-sur-Mer (FR); Sylvain Meillerais, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 29 days.

(21) Appl. No.: 16/769,957

(22) PCT Filed: Nov. 21, 2018

(86) PCT No.: PCT/EP2018/082033
§ 371 (c)(1),
(2) Date: Jun. 4, 2020

(87) PCT Pub. No.: WO2019/110301
PCT Pub. Date: Jun. 13, 2019

(65) Prior Publication Data

US 2021/0197997 A1 Jul. 1, 2021

(30) Foreign Application Priority Data

Dec. 4, 2017 (FR) ..... 1761577

(51) Int. Cl.
*B65D 1/02* (2006.01)

(52) U.S. Cl.
CPC ..... *B65D 1/0284* (2013.01)

(58) Field of Classification Search
CPC ..... B65D 1/0284
USPC ..... 215/375, 374; 220/608
See application file for complete search history.

(56) References Cited

U.S. PATENT DOCUMENTS 10,472,119 B2 * 11/2019 Pierre ..... B65D 1/0284
2013/0264305 A1 * 10/2013 Boukobza ..... B65D 23/001 215/375
2016/0144992 A1 * 5/2016 Hermel ..... B65D 1/0284 215/375

FOREIGN PATENT DOCUMENTS

WO WO-2014083255 A1 * 6/2014 ..... B65D 1/0284
WO 2014174210 A1 10/2014
WO WO-2014174210 A1 * 10/2014 ..... B65D 1/0207

OTHER PUBLICATIONS

International search report dated Feb. 18, 2019.

* cited by examiner

*Primary Examiner* — Anthony D Stashick
*Assistant Examiner* — Raven Collins

(57) ABSTRACT

The invention relates to a container made of plastic material comprising a petaloid bottom having an axis of symmetry and comprising a central dome that projects toward the interior of the container; a series of feet projecting toward the exterior of the container that radiate from the central dome and each of which has a crest path that extends from an external edge of the dome to a peak radially remote from the dome; and a series of valleys each formed as a hollow between successive feet. Each crest path has an internal section extending from the external edge of the dome to a junction at a distance R2 from the central axis. Each crest path also has an external section extending from the junction tangentially in line with the internal section to the peak. The distances R1 and R2 are in a ratio where 45%≤R1/R2≤60%.

15 Claims, 3 Drawing Sheets

CONTAINER WITH A PETALOID BASE

The invention concerns the field of containers, in particular bottles or pots, manufactured by blow molding or stretch blow molding from blanks (preforms or intermediate containers) made of plastic material such as polyethylene terephthalate (PET).

A container generally comprises an open neck, through which it is filled or emptied, a body, which confers upon the container its volume, and a bottom that closes the body at the end opposite the neck and forms a base for standing the container on a support such as a table.

Some contents, typically carbonated drinks, generate in the capped containers high relative pressures that routinely reach or exceed two bar and a half.

To receive this type of content it is standard practice to provide the containers with petaloid bottoms that comprise projecting, feet, in the shape of petals, separated by concave wall portions called hollows or valleys that extend radially from a central zone of the bottom. The feet are intended to stabilize the container on a support while the valleys are intended to absorb thermal and/or mechanical forces exerted by the contents.

A petaloid bottom, one example of which is proposed in European patent application EP3059175 (Sidel) is by virtue of its construction more resistant to deformation than an ordinary bottom. However, the conditions, in particular of temperature and of relative humidity, to which some containers are subjected sometimes stretches the material beyond its elastic limit, or even to the point of rupture. Such conditions are encountered in particular in some hot countries.

Thus storing a container in full sunlight expands the contents and significantly increases the relative pressure inside the container, up to four or even five bar or beyond.

Moreover, if subjected to a very hot and humid atmosphere (as encountered in countries in the tropics), PET undergoes a high re-uptake of moisture which reduces its dimensional stability.

This explains the appearance of cracks in the bottom, to the point where some containers sometimes begin to leak.

A seemingly obvious solution to increase the strength of a petaloid bottom is to increase its thickness, that is to say the quantity of material used to make it. However, two difficulties are encountered. The first difficulty is the necessity, for economic and environmental reasons, to maintain the quantity of material at a reasonable level (manufacturers are even required not to increase the quantity of material or even to reduce it. The second difficulty is that increasing the thickness of the bottom modifies its forming conditions and, to obtain good mold imprint filling, requires a higher pressure for blow molding the container.

One objective of the present invention is consequently to propose a container with a petaloid bottom the shape of which improves its mechanical performance and more precisely renders it more resistant to deformation if it is subjected to high temperature and/or relative humidity conditions.

To this end there is proposed a container made of plastic material comprising a body and a petaloid bottom that is connected to the body by a periphery, the bottom having a central axis of symmetry and comprising:

- a central dome that projects toward the interior of the container, delimited by a circular external edge at a distance R1 from the central axis;
- a series of feet projecting toward the exterior of the container each of which radiates from the central dome and each of which has a peek radially remote from the central dome and a crest path that extends from the external edge of the central dome to the peak;
- a series of valleys each formed as a hollow between two successive feet, each valley radiating from an internal end to the periphery;

said container being characterized in that:

each crest path has:

- an internal section that extends from the external edge of the dome to a junction at a distance R2 from the central axis, said internal section having in a median radial plane of the foot a first curvature;
- an external section that extends from the junction tangentially in line with the internal section to the peak, said external section having in the median radial plane of the foot a second curvature greater than the first curvature;

the distances R1 and R2 are in a ratio such that:

$$45\% \leq R1/R2 \leq 60\%$$

Such a structure confers on the bottom a strength, in particular a thereto-mechanical strength, higher than that of known petaloid bottoms and, for an equivalent quantity of material, renders the bottom more resistant to high temperature and/or relative humidity conditions, as encountered in particular in countries in the tropics.

Various supplementary features may, be provided, separately or in combination. Accordingly, for example:

- The ratio R1/R2 may be between 45% and 55% inclusive.
- The container having a capacity by volume of 1.5 L, the ratio R1/R2 is approximately 50%.
- The peak of each foot is at a distance R3 from the central axis and the distances R and R3 are in a ratio such that:

$$25\% \leq R1/R3 \leq 35\%$$

- For a container having a capacity by volume of 1.5 L, the distances R1 and R3 are advantageously in a ratio R1/R3 of approximately 27%.
- The internal end of each valley is spaced from the external edge of the central dome by a distance E.

This distance E and the distances R1 and R2 are advantageously in a relation such that $45\% \leq E/(R2-R1) \leq 55\%$, preferably with $E/(R2-R1) \cong 50\%$.

- The bottom has a connecting fillet between the internal end of each valley and the external edge of the central dome.
- At the junction between the internal section and the external section the crest path has a width L1 and at a distance R2 from the central axis the valley has a width L2 such that $60\% \leq L1/L2 \leq 210\%$.
- For a container having a capacity by volume of 1.5 L the widths L1 and L2 are preferably equal or substantially equal.
- At the distance R2 from the central axis, a median point of the crest path and a median point of the valley are spaced, firstly, axially by a distance H and, secondly, in a transverse plane perpendicular to the central axis, by a distance G such that $20\% \leq H/G \leq 30\%$.
- For a container having a capacity by volume of 1.5 L the distances H and G are advantageously in a ratio H/G of approximately 25%.
- The external section of the crest path is straight and forms with a transverse plane perpendicular to, the central axis an angle between 21° and 24° inclusive, for example approximately 22.5°.

Other objects and advantages of the invention will become apparent in the light of the description of one embodiment given hereinafter with reference to the appended drawings, in which.

Figure 1:
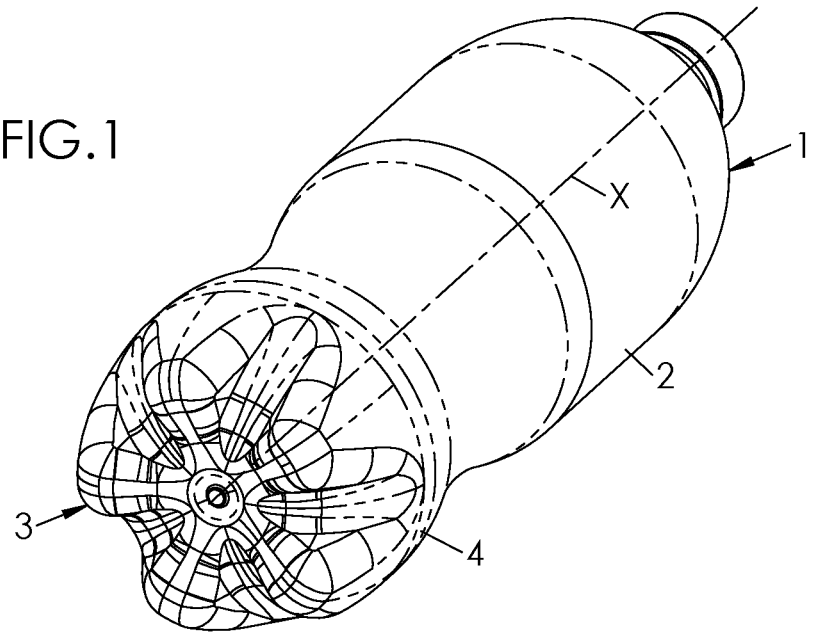
FIG. 1 is a perspective view from below of a container having a petaloid bottom.
Figure 2:
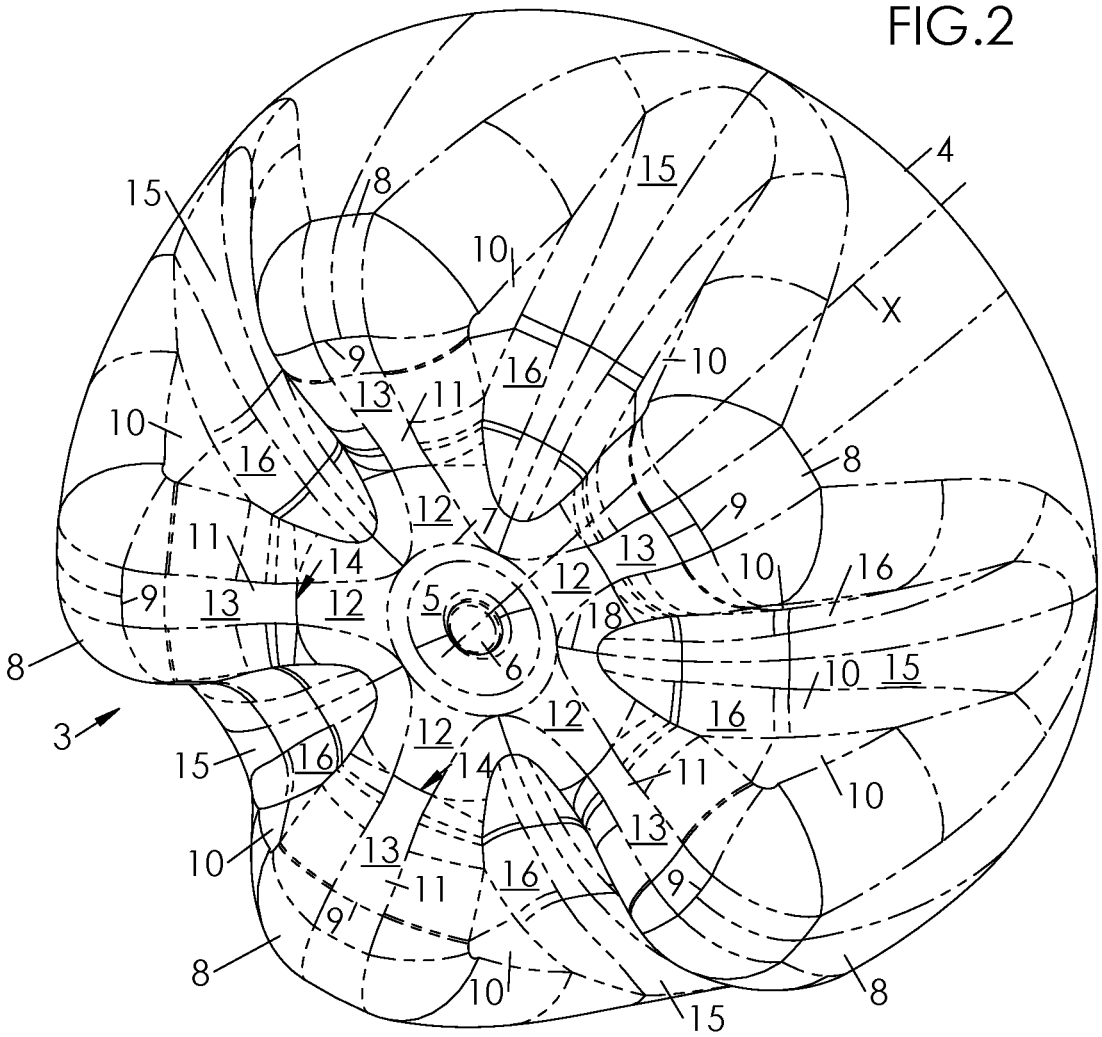
FIG. 2 is a detail view in perspective showing the bottom to a larger scale.
Figure 3:
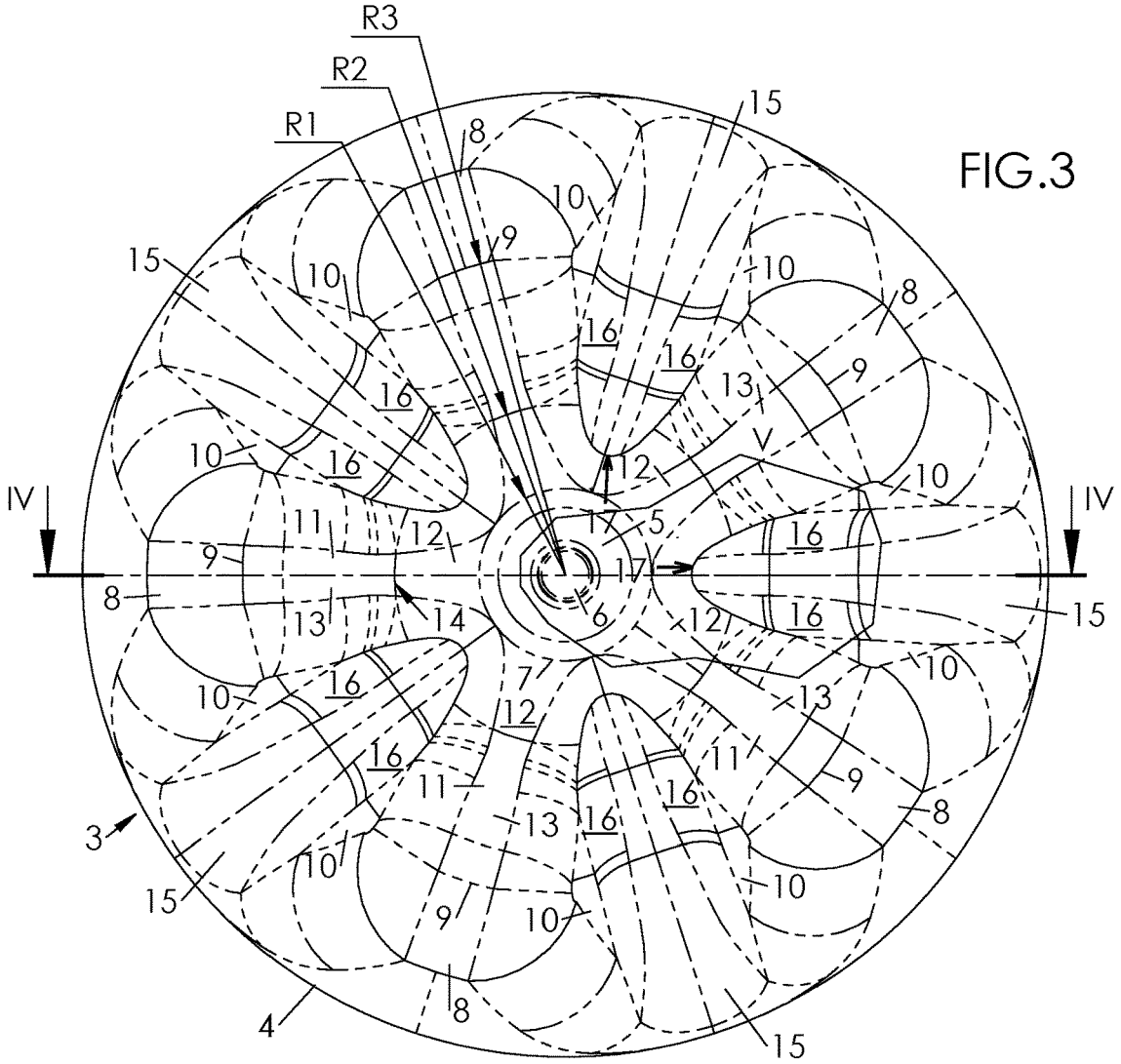
FIG. 3 is a view from above, of the bottom of the container.

In FIG. 1 is represented, in perspective from below, a plastic material container 1 (in this instance this is a bottle). The container is obtained by forming (blow molding or stretch blow molding) a preform made of thermoplastic polymer, for example polyethylene terephthalate (PET). Before forming the preform is heated so that the material reaches a temperature above its glass transition temperature (which is approximately 80° C. in the case of PET).

The container 1 extends along a central axis X. It includes a lateral wall called the body 2 and a petaloid bottom 3 that closes the container 1 at a lower end of the body 2.

The bottom 3 has a periphery 4 by which it is connected to the body 2. The bottom 3 has a central axis of symmetry which in the configuration shown coincides with the central axis X of the container 1.

The bottom 3 includes, firstly, a central dome 5 that projects toward the interior of the container 1. In the example shown the dome 5 takes the form of a toroidal or hemispherical dome the concavity of which faces toward the exterior of the container 1.

A lump 6 at the center of the dome 5 formed by the injection molding, the material of which has remained substantially amorphous during the forming of the container 1, projects axially toward the exterior of the container 1.

The dome 5 has in particular the function of stretching the material at the center of the bottom 3 so as to increase the crystallinity and therefore the mechanical strength.

Figure 4:
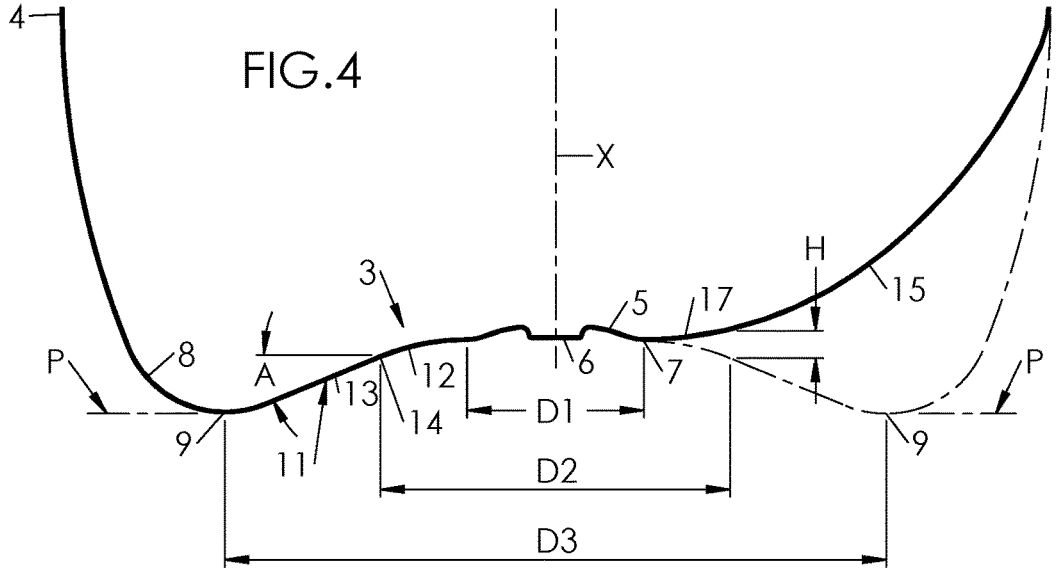
FIG. 4 is a view in section of the bottom from FIG. 3 taken along the line IV-IV.

The dome 5 is delimited by a circular external edge 7 at a distance R1 from the central axis X. D1 denotes the diameter of the circular external edge 7 (FIG. 4). D1 is such that D1=2·R1.

The bottom 3 includes, secondly, a series of feet 8 projecting toward the exterior of the container 1 that radiate from the central dome 6. Each foot 8 has a peak 9 that is its farthest projecting part.

Each foot 8 is bordered laterally on either side by a pair of flanks 10 of substantially triangular shape.

Together, the peaks 9 lie in a common plane P, called the support surface, via which the container 1 is able to rest on a plane surface (for example a table).

Each foot 8 has a facet called the crest path 11 that extends radially and slopes from the external edge 7 of the central dome 5 to the peak 9.

Each crest path 11 has from the inside (that is to say the side of the central axis X) to the outside (that is to say the side of the periphery 4) two successive sections, namely an internal section 12 and an external section 13 that join at a junction 14.

The junction 14 is at a distance R2 from the central axis X. D2 denotes the diameter of the circle joining the junctions 14 (FIG. 4). D2 is such that D2=2·R2.

The internal section 12 extends from the external edge 7 of the dome 5 to the junction 14 with the external section 13. The internal section 12 has in a median radial plane of the foot (corresponding to the section plane of FIG. 4 and of FIG. 6) a first curvature C1. If the internal section 12 has a circular contour (when seen in section in the median radial plane) the first curvature C1 corresponds to the radius of curvature of the internal section 12. If not, the first curvature C1 may be considered as being the mean curvature of the internal section 12 measured in the median radial plane.

The external section 13 extends from the junction 14 with the internal section 12, tangentially in line with the latter, to the peak 9 of the foot 8.

The external section 13 has in the median radial plane of the foot 8 (corresponding to the section plane of FIG. 4 and of FIG. 6) a second tyre C2 if the internal section 13 has a circular contour (when seen in section in the median radial plane) the second curvature C2 corresponds to the radius of curvature of the internal section 13. If not, the second curvature C2 may be considered as being the mean curvature of the external section 13 measured in the median radial plane.

The second curvature C2 is greater than the first curvature C1:C2≥C1.

Figure 6:
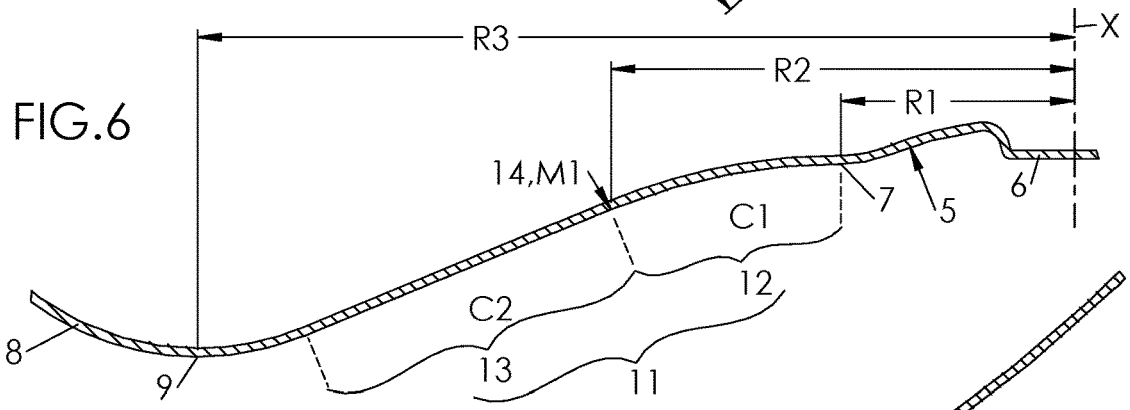
FIG. 6 is a detail view in section of the bottom in a median radial plane of a foot.

In accordance with a preferred embodiment shown in FIG. 4 and in FIG. 6 the external section 13 is straight that is to say the second curvature C2 is infinite. In this case, the external section advantageously forms with any transverse plane perpendicular to the central axis X an angle A between 21° and 24° inclusive and preferably of approximately 22.5° (FIG. 4).

The position of the junction 14 between the internal section 12 and the external section 13 depends on the size of the dome 5. To be more precise, the distances R1 and R2 are in a ratio such that:

$$45\% \leq R1/R2 \leq 60\%$$

In accordance with a preferred embodiment, the ratio R1/R2 is rather between 45% and 55% inclusive.

For a container 1 with a capacity by volume of 1.5 L the ratio R1/R2 is approximately 50%.

R3 denotes the distance from each peak 9 to the central axis X. D3 denotes the diameter of the circle inscribed in the polygon joining the peaks 9 (FIG. 4). D3 is such that D3=2·R3.

Note that the peaks 9 are set back in the radial direction relative to the periphery 4 of the bottom 3. In other words, the diameter D3 is less than the overall diameter of the bottom 3 (which in the example shown corresponds to the overall diameter of the container 1).

The distances R1 and R3 are advantageously such that 25%≤R1/R3≤35%.

For a container 1 having a capacity by volume of 1.5 L the distances R1 and R3 are preferably in a ratio R1/R3 of approximately 27%.

The bottom 3 includes, thirdly, a series of valleys 15 each formed as a hollow between two successive feet 8. Each valley 15 is connected to each of the flanks 10 that border it by a connecting fillet 16.

Each valley 15 radiates from an internal end 17 to the periphery 4 of the bottom 3.

Figure 5:
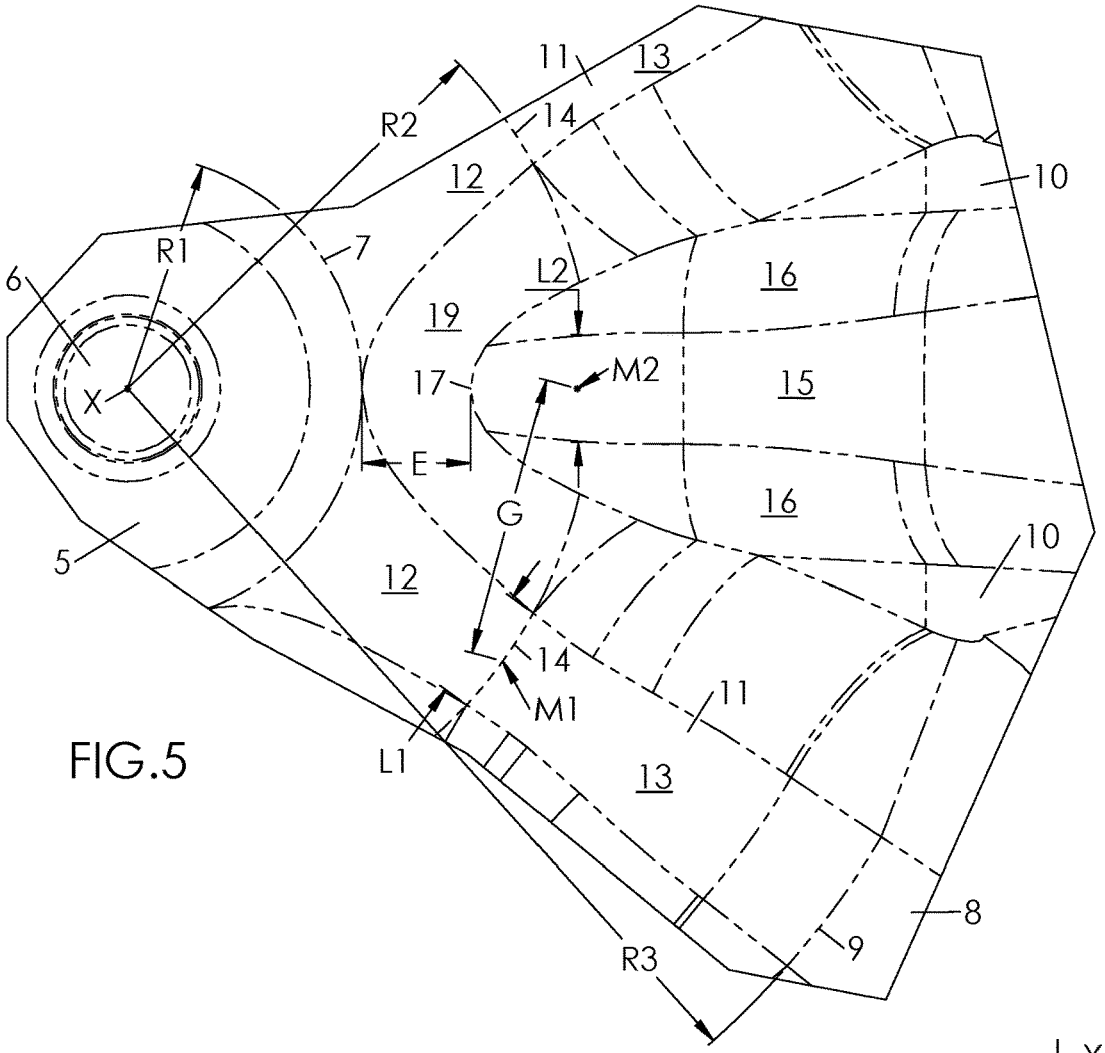
FIG. 5 is a detail view to a larger scale of the bottom from FIG. 3 within the medallion V.

As shown in FIG. 5 in particular the internal end 17 of each valley 15 is spaced from the external edge 7 of the central dome 5 by a distance E. In accordance with a preferred embodiment shown in FIG. 5 the valley 15 appears rounded at its internal end 17 when the bottom is seen from below.

The distance E from the internal end 17 of each valley 15 to the external edge 7 of the central dome 5 and the distances R1 and R2 are advantageously in a relation such that:

$$45\% \leq E/(R2-R1) \leq 55\%$$

In accordance with a preferred embodiment, the distance E from the internal end 17 of each valley 15 to the external edge 7 of the central dome 5 and the distances R1 and R2 are in a relation such that:

$$E/(R2-R1) \approx 50\%$$

Figure 7:
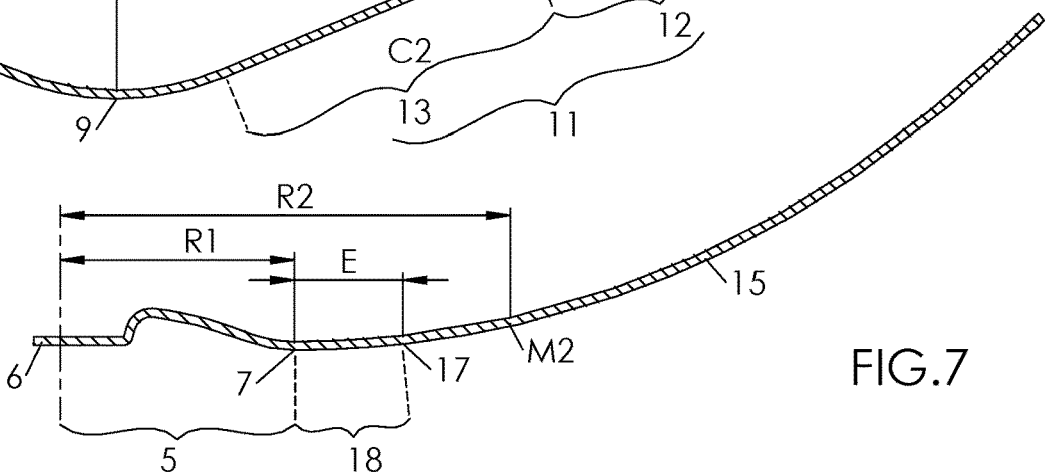
FIG. 7 is a detail view in section of the bottom in a median radial plane of a valley.

As can be seen in FIG. 7 the bottom 3 has a connecting fillet 18 between the internal end 17 of each valley 15 and the external edge 7 of the central dome 5. This connecting fillet 18 is part of a larger connecting zone 19 of crescent shape when seen from below (that is to say in the plane of FIG. 5), which produces a gentle junction:

radially, between the valley 15 (at its internal end 17) and the external edge 7 of the central dome 5;

laterally, between the valley 15 and the internal section 12 of each crest path 11.

Each crest, path 11 as a width L1 at the junction between the internal section 12 and the external section 13 (that is to say at the distance R2 from the central axis X).

Moreover, at the distance R2 from the central axis X each valley 5 advantageously has a width 12 such that 60%≤L1/L2≤210%.

The value of the ratio L1/L2 may in particular depend on the capacity by volume (and therefore the overall diameter) of the container 1. Accordingly, for a container 1 having a capacity by volume of 1.5 L the widths L1 and L2 are advantageously equal (that is to say that the difference between L1 and L2 is less than 5%) or substantially equal (that is to say the difference between L1 and L2 is between 5% and 10% inclusive).

Referring to FIG. 4 and FIG. 5:

M1 denotes the (geometrical) median point of the crest path 11 situated at the distance R2 from the central axis X ((in other words, the point M1 is the center of the segment forming the junction 14 between the internal section 12 and the external section 13 of the crest path 11);

M2 denotes the median point of the valley 15 situated at, the distance R2 from the central axis X;

H denotes the distance measured axially between the points M1 and M2 (and more precisely between the transverse planes perpendicular to the central axis X and respectively passing through the point M1 and the point M2);

G denotes the distance separating M1 and M2 in a transverse plane perpendicular to, the axis X (and to be more precise the distance separating the axial projections of M1 and M2 on such a plane, which corresponds for example to the plane of FIG. 5).

The distances H and are advantageously in a ratio H/G such that 20%≤H/G≤30%.

For a container 1 having a capacity by volume of 1.5 L the distances H and G are preferably in a ratio H/G of approximately 25%.

Structured in this way, the bottom 3 has a higher thermo-mechanical strength than an ordinary petaloid bottom for an equivalent quantity of material. To be more precise tests have shown that the bottom 3 is more resistant to high temperature and/or relative humidity conditions.

This performance stems in particular from the gently curved shape of the bottom 3 which ensure good distribution of forces and minimize the concentration of stresses in one (or more) localized are (s). This gently curved shape results in particular from the location of the junction 14 between the internal section 12 and the external section 13 of the crest path 11 of the feet 8, characterized by the ratio R1/R2.

Here the presence of the dome 5 is necessary for the structural rigidity of the bottom 3. If the junction 14 were too close to the external edge 7 of the latter the transition between the internal section 12 of the crest path 11 and the dome would be too brutal and there would then be observed the appearance of a concentration of stresses over the internal section 12. If on the other hand the junction 14 were too close to the foot 8 the bottom 3 would have too low a height and would provide insufficient mechanical strength.

The spacing distance E between the valleys 15 and the dome 5 also enables, via the connecting fillet 18, a gentle transition between them. Moving closer together the internal end 17 of the valleys 15 of the dome 5 would educe the radius of the connecting fillet 18 and would increase the concentration of stresses over the latter. Taken to the extreme, having the valleys open out onto the central dome would cause a stress peak to appear at the junction between the valleys and the dome.

The relatively low ratio H/G and the contrary relatively high ratio L1/L2 also contribute (be it indirectly and in a secondary manner) to the gently curved shape of the bottom 3 and therefore to the distribution of forces over the latter.

It is even found that, if the filled and capped container 1 is subjected to high temperature (above 40°) and/or high relative humidity (above 50%) conditions the bottom 3 is deployed slightly (that is to say that the diameter D3 increases somewhat) in a uniform manner. This results in an improvement in the seating of the container 1 to the benefit of its stability.

The invention claimed is:

1. A container (1) made of plastic material comprising a body (2) and a petaloid bottom (3) that is connected to the body (2) by a periphery (4), the bottom (3) having a central axis (X) of symmetry and comprising:

a central dome (5) that projects toward an interior of the container (1), delimited by a circular external edge (7) at a distance R1 from the central axis (X);

a series of feet (8) projecting toward an exterior of the container (1) each of which radiates from the central dome (5) and each of which has a peak (9) radially remote from the central dome and a crest path (11) that extends from the circular external edge (7) of the central dome (5) to the peak (9);

a series of valleys (15) each formed as a hollow between successive feet (8), each valley (15) radiating from an internal end (17) to the periphery (4);

wherein:

each crest path (11) has:

an internal section (12) that extends from the external edge (7) of the dome (5) to a junction (14) at a distance R2 from the central axis (X), said internal section (12) having in a median radial plane of the foot (8) a first curvature (C1);

an external section (13) that extends from the junction (14) tangentially and in line with the internal section (12) to the peak (9), said external section (13) having in the median radial plane of the foot (8) a second curvature (C2) greater than the first curvature (C1);

the distances R1 and R2 are in a ratio such that:

$$45\% \leq R1/R2 \leq 60\%.$$

2. The container (1) as claimed in claim 1, wherein the ratio R1/R2 is between 45% and 55% inclusive.

3. The container (1) as claimed in claim 2, wherein, the container (1) having a capacity by volume of 1.5 L, the ratio R1/R2 is approximately 50%.

4. The container (1) as claimed in claim 1, wherein:

the peak (9) of each foot (8) is at a distance R3 from the central axis (X);

the distances R1 and R3 are in a second ratio such that:

$$25\% \leq R1/R3 \leq 35\%.$$

5. The container (1) as claimed in claim 4, wherein, the container (1) having a capacity by volume of 1.5 L and the second ratio R1/R3 is approximately 27%.

6. The container (1) as claimed in a claim 1, wherein the internal end (17) of each valley (15) is spaced from the external edge (7) of the central dome (5) by a distance E.

7. The container (1) as claimed in claim 6, wherein the distance E from the internal end (17) of each valley (15) and the distances R1 and R2 are in a relation such that:

$$45\% \leq E/(R2-R1) \leq 55\%.$$

8. The container (1) as claimed in claim 7, wherein the distance E from the internal end (17) of each valley (15) to the external edge (7) of the central dome (5) and the distances R1 and R3 are in the relation such that:

$$E/(R2-R1) \approx 50\%.$$

9. The container (1) as claimed in claim 1, wherein the bottom (3) has a connecting fillet (18) between the internal end (17) of each valley (15) and the external edge (7) of the central dome (5).

10. The container (1) as claimed in claim 1, wherein:

at the junction (14) between the internal section (12) and the external section (13) the crest path (11) has a width L1;

at the distance R2 from the central axis (X) the valley (15) has a width L2 such that:

$$60\% \leq L1/L2 \leq 210\%.$$

11. The container (1) as claimed in claim 10, wherein, the container (1) having a capacity by volume of 1.5 L, the widths L1 and L2 are equal or substantially equal.

12. The container (1) as claimed in claim 1, wherein, at the distance R2 from the central axis (X), a median point (M1) of the crest path (11) and a median point (M2) of the valley (15) are spaced, firstly, axially by a distance H and, secondly, in a transverse plane perpendicular to the central axis (X), by a distance G such that:

$$20\% \leq H/G \leq 30\%.$$

13. The container (1) as claimed in claim 12, wherein, the container (1) having a capacity by volume of 1.5 L, the distances H and G are in a ratio H/G of approximately 25%.

14. The container (1) as claimed in claim 1, wherein the external section (13) of the crest path (11) is straight and forms with a transverse plane perpendicular to the central axis (X) an angle (A) between 21° and 24° inclusive.

15. The container (1) as claimed in claim 14, wherein the angle (A) is approximately 22.5°.

* * * * *